US005511889A

United States Patent [19]

Tokar

[11] Patent Number: 5,511,889

[45] Date of Patent: Apr. 30, 1996

[54] RIBBON INKING DEVICE

[75] Inventor: Gladys J. Tokar, Saskatchewan, Canada

[73] Assignee: T-3 Enterprises Inc., Regina, Canada

[21] Appl. No.: 367,169

[22] PCT Filed: Jul. 6, 1992

[86] PCT No.: PCT/CA92/00277

§ 371 Date: Jan. 6, 1995

§ 102(e) Date: Jan. 6, 1995

[87] PCT Pub. No.: WO94/01287

PCT Pub. Date: Jan. 20, 1994

Related U.S. Application Data

[63] Continuation-in-part of Ser. No. 633,683, Dec. 26, 1990, abandoned.

[51] Int. Cl.[6] ..... B41J 31/14

[52] U.S. Cl. ..... 400/197; 400/200

[58] Field of Search ..... 400/197, 202.2, 400/202.3, 202.4, 202.1, 202, 200, 201, 199, 198; 118/235; 427/141, 140

[56] References Cited

U.S. PATENT DOCUMENTS

| | | | |
|---|---|---|---|
| 4,126,715 | 11/1978 | Schiffmacher et al. | 427/141 |
| 5,048,986 | 9/1991 | Czesnik et al. | 400/202 |
| 5,190,385 | 3/1993 | Taguchi et al. | 400/197 |
| 5,201,592 | 4/1993 | Mizutani et al. | 400/201 |
| 5,372,438 | 12/1994 | Chung | 400/197 |

FOREIGN PATENT DOCUMENTS

| | | | |
|---|---|---|---|
| 0049292 | 3/1983 | Japan | 400/202.4 |

*Primary Examiner*—Edgar S. Burr
*Assistant Examiner*—Anthony H. Nguyen
*Attorney, Agent, or Firm*—Adrian D. Battison; Murray E. Thrift

[57] ABSTRACT

Disclosed herein is ribbon inking apparatus for inking such ribbon comprising an ink supply in the form of an ink cartridge with a motor actuated piston forcing the ink onto a porous inking wheel which is also the main ribbon drive. A cartridge with ribbon to be inked has an adapter placed thereon to suit the type of cartridge and is inserted into the inking apparatus where it is held in engagement with a friction drive. Puller arms actuated from the main gear box have puller fingers which grasp the ribbon from the cartridge and place a portion thereof against the porous inking wheel for inking. A pinch roller, ink sensor, unit is pivoted into a position where the pinch roller forces the ribbon against the inking wheel and the ink sensors straddle the ribbon to detect the presence of ink and to control the application of ink to the inking wheel.

10 Claims, 5 Drawing Sheets

RIBBON INKING DEVICE

This application is a continuation-in,part of International Application Ser. No. PCT/CA92/00277 designating USA and filed Jul. 6th, 1992 which is now abandoned and is a continuation-in-part of application Ser. No. 07/633683 filed Dec. 26th, 1990 and now abandoned.

BACKGROUND OF THE INVENTION

This invention relates to a device for inking a ribbon of the type comprising a cartridge with a loop of the ribbon exposed from the cartridge and a drive member on the cartridge for feeding the ribbon from the loop back into the cartridge.

Apparatus for inking ribbons are well known in the art and basically comprise ink supply means, ribbon guide and drive means and ink transfer means to apply ink to the ribbon from the supply means as it passes over the ink transfer means. The supply of ink has most commonly been a reservoir with the ink being transferred by a wick to a roller which transfers the ink onto the ribbon. The roller and ribbon drive being driven by a small electric motor. Some ink supply means were by gravity feed and proved very difficult to regulate and were consequently very messy. The amount of ink being applied was normally a timing process, others used the spatial relationship or amount of pressure contact between the feed and inking rollers to determine the amount of inking composition to be transferred.

A search of the prior art has revealed the following Canadian Patents 1059740, 1052560, 676889 and 656611. In Canadian Patent "740" there is disclosed both a gravity feed, wick transfer of ink to the ribbon and a conventional spraying device for transfer of ink to the ribbon In Canadian Patent "560", there is basically disclosed a cam controlled ink applying means the ink being transferred from a reservoir to an inking roller, while applicants application of ink is by a stepper motor driven syringe applying ink to a porous inking and main driving wheel. Looking at Canadian Patent "611" we have an ink cartridge feeding a felt wick contracting a transfer roller Canadian Patent "889" teaches only a special type wick applying ink to a roller from a supply basin.

SUMMARY OF THE INVENTION

It is one object of the present invention to provide a device for inking ribbons of the above type which effectively enables automatic inking by reducing requirement for operator action in handling and controlling the movement of the inked ribbon and by enabling the device to operate on different types of cartridge.

According to the invention there is provided ribbon inking device for inking an endless ribbon movably mounted in a ribbon cartridge with a loop of the ribbon exposed from the cartridge and a drive member on the cartridge for feeding the ribbon from the loop back into the cartridge, the device comprising a base, main drive means mounted on the base, ink applying means mounted on the base and including an ink supply, ribbon driving means for driving said ribbon from said loop over said inking means, said ribbon driving means being driven from said main drive means, ribbon positioning means for grasping said ribbon at said loop and for moving the ribbon into position for driving by said ribbon driving means, cartridge drive means for driving said drive member on the cartridge, cartridge support means including a support table mounted on said base and means for moving the cartridge drive means to a required location for engagement with said drive member of said cartridge on said cartridge support means.

Preferably the apparatus includes an adapter plate to be placed on the cartridge with the ribbon to be inked. The cartridge with adapter is inserted onto the base plate of the device where it is held in engagement with a friction drive head. The drive head is driven by a main motor gear box assembly located beneath a supporting table. The main motor gear box assembly also drives an inking wheel which is also the main ribbon driving wheel. A syringe type ink supply cartridge has a piston driven by a stepper motor controlled by a requirement sensor to apply ink to the porous inking wheel. Puller arms operated by the main motor gear box are located below the supporting table but have fingers that protrude above the table and engage the cartridge ribbon and draw it out into engagement with the inking drive wheel where it is inked and driven when the syringe is activated.

The apparatus further includes a pivotable assembly having a pinch roller to further hold the ribbon against the inking wheel when pivoted and two optical sensors each one straddling a portion of the ribbon for an opacity check to see if the ribbon has in fact had ink applied thereto. The ribbon can be run through more than once for darker inking. Various colors of ink cartridge may be used. When the desired amount of ink has been applied the flow of ink stops, the pinch roller and optical sensor pivot are moved out of the way to a parked position and the arms with ribbon return to the start position and the inked ribbon is then removed.

BRIEF DESCRIPTION OF THE DRAWINGS

Embodiments of the invention will now be described in the following description to be read in conjunction with the accompanying drawings, in which.

DETAILED DESCRIPTION

Figure 1:
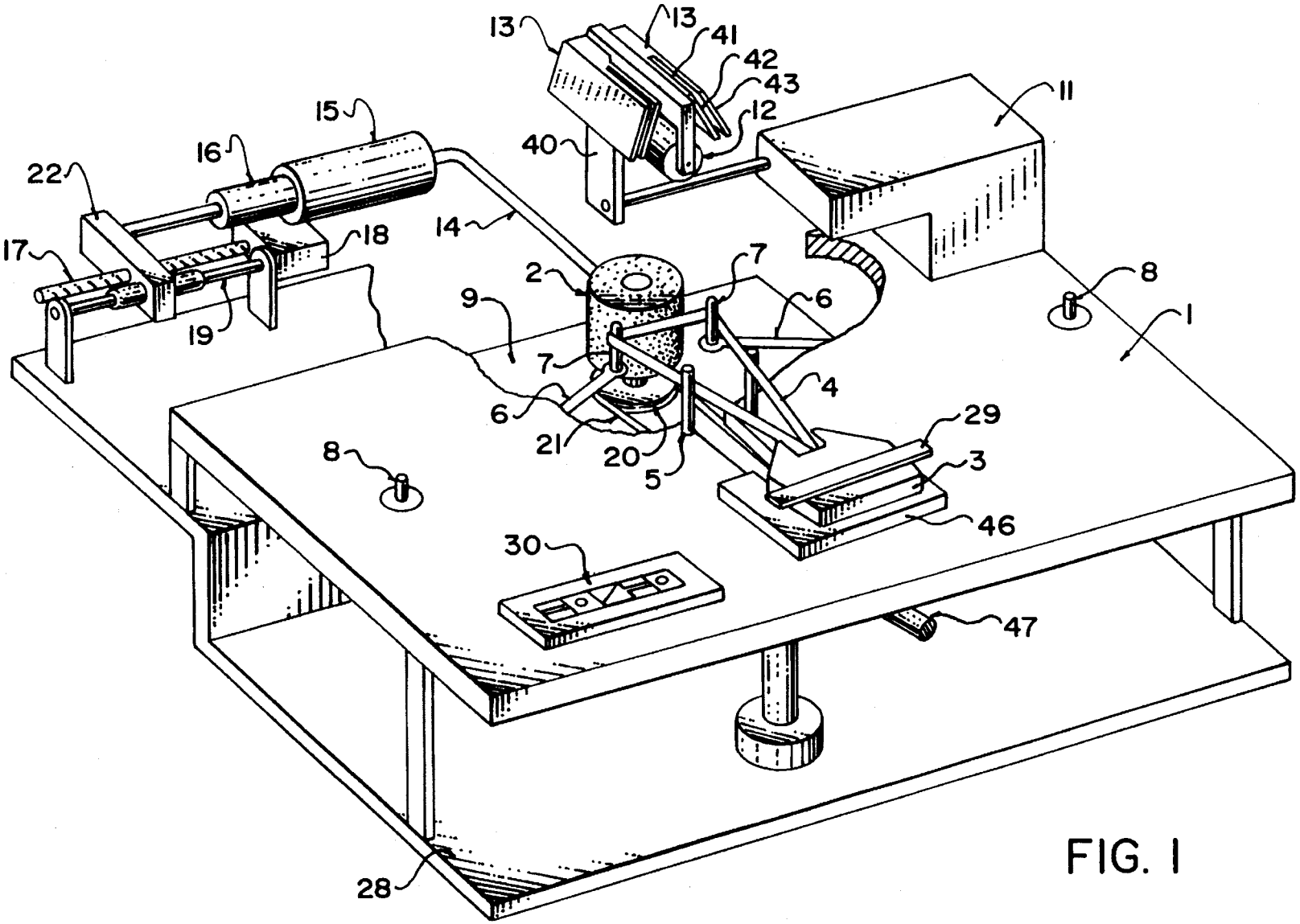
FIG. 1 is a perspective view of the instant invention with a ribbon in position to be inked.

Referring now to FIG. I of the drawings a base 28 is provided with a support table 1 mounted thereon. The ribbon inking and handling mechanisms mounted on the support table 1 and base 28 are covered by a suitable casing (not shown). The top of the casing is removable to replace the ink cartridge and to service the working components. An opening is provided in the front to receive the cartridge with the ribbon. Some models have a video cassette type receiver lowering the ribbon cartridge with appropriately selected drive adapter on to the friction drive 27 where it is held in place by holdown 29. A control panel 30 is mounted either on the casing or on the support table 1.

Figure 3:
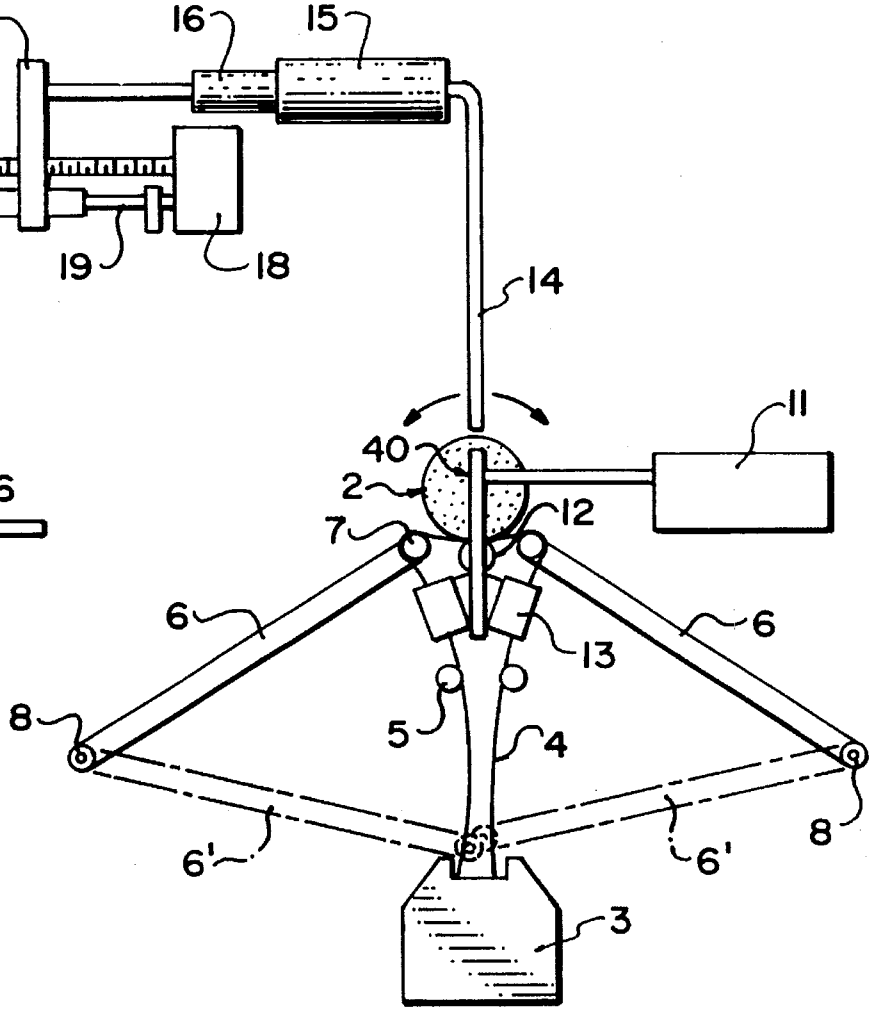
FIG. 3 is a plan view in schematic with support table removed to indicate operation of the ribbon pull-out arms.

For positioning of the tape in the inking position there are provided puller arms 6 with puller fingers 7 which are pivotally mounted to the support table 1 at pivot points 8 and are actuated by gear box 9. Included in the ribbon positioning means are ribbon guides 5 mounted on support table 1. The puller fingers 7 in their start position shown in phantom in FIG. 3 initially are moved from a retracted position below the base upwards into the loop of ribbon exposed at the front of the cartridge where they pick up the ribbon 4 in the loop portion thereof which extends from the cartridge 3. The pivoting of puller arms 6 moves the ribbon 4 into contact with the driving inker wheel 2.

For driving the ribbon 4 there are provided the driving inker wheel 2 and the friction drive 27. The driving inker wheel 2 is the main drive to ensure inking at a constant rate and is connected to gear box 9. Friction drive 27 is driven faster than wheel 2 is also connected to gear box 9 through a pulley drive 20, 21 and 26. A slip clutch 23 will be necessary under certain conditions. The friction drive 27 is supported at the lower end on the, base 28 by drive support 24 and at the top by support table 1. For the application of ink to the ribbon 4 there is provided the driving inker wheel 2 which is manufactured of a material having a porous surface. In close proximity to inker wheel 2 is an ink extruder 14 which can be moved longitudinally of the driving inker wheel axis to place the extruded ink at a most desirable location relative to the location of the ribbon 4 which contacts the inker drive wheel 2. The ink extruder 14 extends from a syringe type ink cartridge 15 which has a piston 16 driven by a piston pressure block 22 set in motion by a stepper motor 18 rotating a screw 17 and guided 29 by a piston guide rod 19. The most desirable rate of extrusion is approximately 0.001 ml/cm of ribbon and the discharge opening is approximately 0.04 inch (1.01 mm). To ensure a more positive drive and uniform distribution of the ink on the ribbon a pinch roller 12 is provided. It is pivoted into position by pivot actuator 11 forcing the ribbon 4 against the driving inker wheel 2.

Also mounted with pinch roller 12 on a common support 40 are two monitoring sensors 13 which are pivoted over the ribbon 4 when in inking position. The sensors each consist of an optical sender 42 and a cooperating receiver 43 mounted either side of a slot 41 over the ribbon such that a signal can be transmitted through the ribbon and received on the other side. The sender/receiver pairs are positioned on either side of the driving inker wheel 2 to allow for clockwise or counter clockwise ribbon drive rotation and also to detect the status of the ribbon o before and after inking. The ink sensors 13 also sense the location of the ribbons top, bottom, and the printers track as generated by the locus of the printing head of the machine on which the ribbon has been used. As previously mentioned the ink extruder 14 is moved up or down under control of the control unit 30 in response to the sensors 13 so the ink can be applied mainly to the part of the driving inker wheel that will contact the track area. If there is no definable track area (such as with a new ribbon) the extruder will apply ink to the driving inker wheel 2 so that most of the ink will be applied to the midpoint of the ribbon.

If the operator has selected "medium" on a darkness control system of the control unit 30 the machine shuts down after a single pass over the whole of the ribbon and alert the operator that the cycle is complete. The completion of one whole pass is detected by the optical sensors in response to a change in opacity of the incoming ribbon upstream of the inker wheel.

If the operator selects "dark" on the darkness control the machine repeats the cycle of the ribbon and continue for the same length of time it takes to make the first pass. "Ultra-dark" can be set including a third pass. Thus the control unit 30 includes a timer for generating a time period responsive to a first complete pass of the ribbon through the inker. This time period is then used to effect a second and if necessary a third pass based upon time since the changes in ink level cannot be detected optically. Depending on the adapter plate selected which relates to the type of cartridge in use, the machine has a pre-set time-out that shuts down the inking process if the normal ink detection method fails to detect a completion of the first cycle for example in the circumstance where there is no ink in the supply or the drive fails to forward the ribbon.

Figure 2:
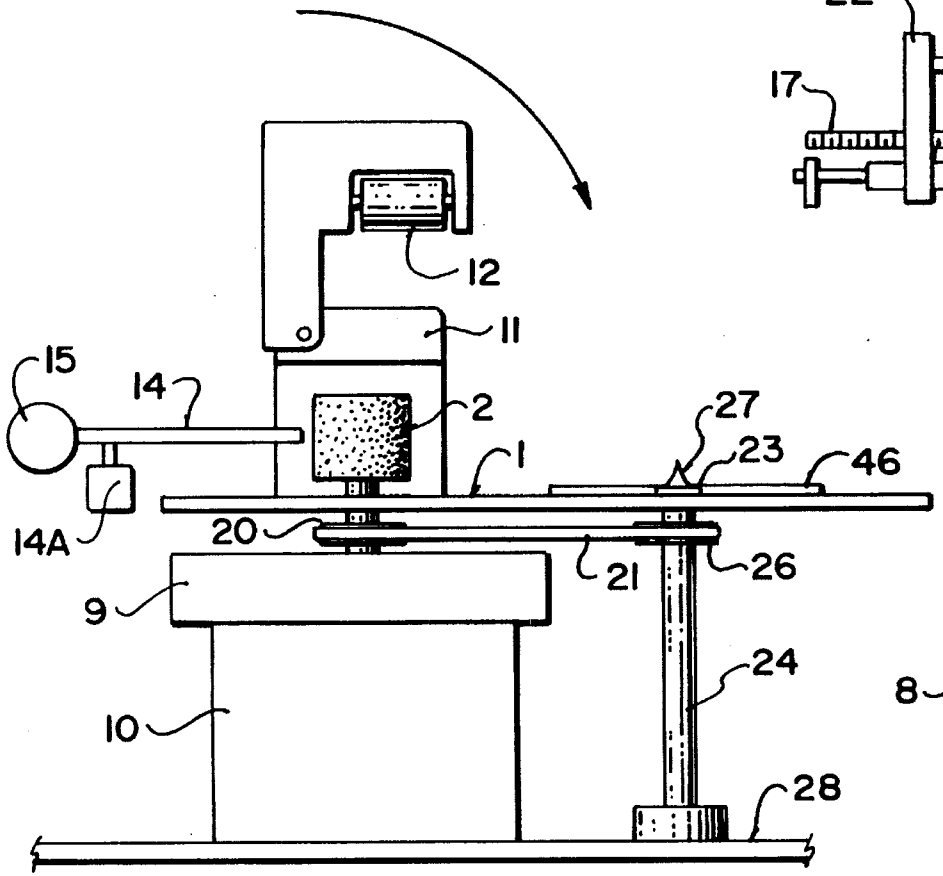
FIG. 2 is a side elevation view in schematic with ink cartridge drive, optical sensors, ribbon transfer arms and ribbon cartridge removed for clarity.

Now referring to FIG. 2 there is shown a side elevation in schematic showing the main drive with main drive motor 10 and gear box 90 mounted on the base 28. There is also shown the drive system with the connection of the driving inker wheel 2 to the gear box 9 and in parallel the belt and pulley system 20, 21 and 26 for the friction drive 27 with slip clutch 23 supported on the base 28 by support 24. The location of extruder tube 14 is also shown as it extends from the cartridge 15 to a position closely adjacent the porous wheel 2. The piston drive has not been shown for reasons of clarity. A device for raising and lowering the tube 14 is shown schematically at 14A and acts under control of the control unit 30. The drawing in FIG. 3 has been shown mainly to illustrate the location of the pivoting puller arms 6 and fingers 7 as they pivot about their pivot points 8 from a rest position 6/to a position where they engage a portion of the ribbon 4. Furthermore there is shown the movement of the common support 40 moving the pinch roller 12 into contact with driving inker wheel 2, and moving the monitoring sensors 13 into the operative position. In the operation of the above apparatus the operator selects an adapter driving plate to suit the specific cartridge 3 with a ribbon 4 to be inked. The cartridge with adapter is inserted into the apparatus either manually or automatically and clamped so that the adapter engages the frictional drive 27.

One of the adapter plates is illustrated at 46 and is mounted on the base plate of the inking device. It will be appreciated that there are a large number of different styles and designs of cartridges manufactured by different companies and it is necessary for the present device to act to ink many or all of these different cartridges. It is necessary therefore firstly to locate the cartridge in the machine so that it is properly held in place during the inking operation. Secondly and more importantly it is necessary to locate the drive element 27 so that it properly engages the cartridge to rewind the loop of ribbon into the cartridge. It will be appreciated that the different cartridges have a different location for the drive member which must be engaged and therefore it is necessary to move the drive element 27 to different locations.

One technique for accommodating the different types of cartridge includes the provision of different adapter plates each associated with a particular style or design of cartridge. One of the adapter plates is shown at 46 and includes means for engaging the underside of the cartridge to locate the cartridge in place with the loop of ribbon exposed at the front of the cartridge and positioned over a slot in the base plate through which the figures of the pulling system can extend. The adapter plate includes an opening for locating the drive 27 which is moved by a lever 47 which slides the shaft 24 to different locations to position the drive through the drive locating mechanism of the adapter plate. With the drive mechanism thus located, the cartridge can be moved into position and operated upon as previously described.

Figure 4:
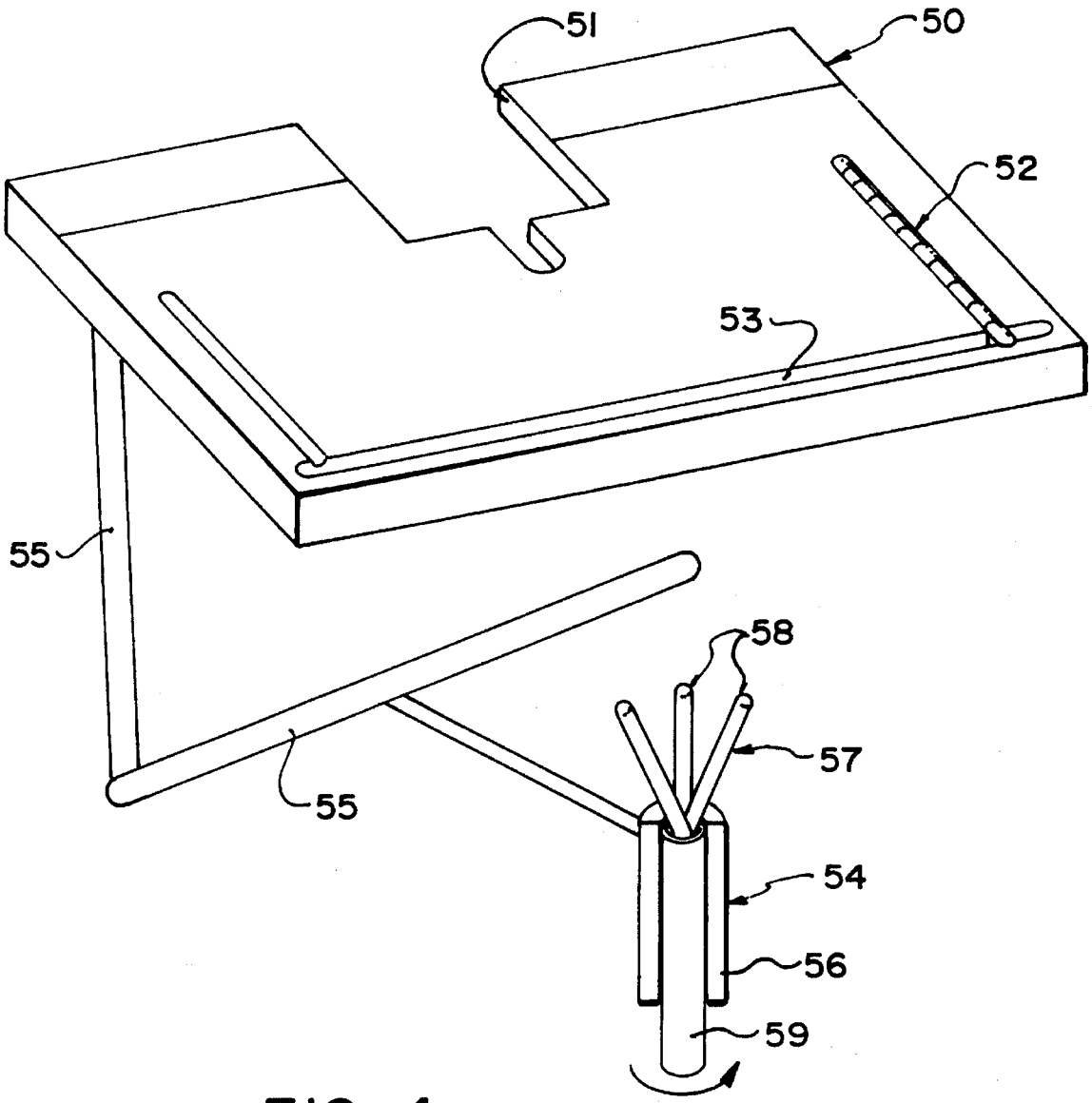
FIG. 4 is a schematic isometric view of an alternative arrangement for locating and driving the drive member of the cartridge.

A second arrangement for accommodating different designs and styles of cartridge is shown schematically in FIG. 4 and comprises a support plate 50 which includes the slot 51 to be located at the front of the cartridge through which the pulling system included in the fingers will operate. The plate 50 includes a scanning system 52 movable along a slot 53 and including an optical sensor system which detects the drive member of the cartridge. The optical sensor thus detects the location of the drive member and electronically marks the location on the support plate 50. A drive member 54 is positioned beneath the plate and is movable by a drive system schematically indicated at 55 so that the drive element can be moved to the required position electronically marked by the scanning system 52. The drive member 54 includes a sleeve 56 within which is retained a drive bit 57 in the form of a "chopstick" arrangement including three drive pins 58 which can be retracted into the sleeve 56 but which expand apart when moved vertically upwardly out of the confines of the sleeve 56. The three pins thus engage into the various different styles of drive member available within the different types of cartridge by the upward vertical movement of the drive element out of the sleeve 56. Rotation of the drive member indicated schematically at 59 is then effected from the drive motor as previously described to cause the overspeed frictional drive to the drive member of the cartridge.

On the control panel 30 the operator selects the amount of ink to be applied to ribbon 4 by selecting "medium", "dark" or "ultra-dark". The operator then selects on control panel 30 the direction of rotation, clock wise or counter clock wise, that the drive will provide which is the one required as indicated on the ribbon cartridge 3. The operator now positions on-off switch on panel 30 to the "on" position, this energizes the main drive motor 10 and gear box 9. The start switch on panel 30 is now engaged to commence the inking cycle. The inking cycle begins with the puller arms 6 with puller fingers 7 in their initial position engaging the ribbon 4 near the ink cartridge 3 and through gear box 9 pivots them with the ribbon 4 to a position where the ribbon engages the driving inker wheel 2. At this point the pivot actuator 11 is energized pivoting the common support unit carrying the optical ink sensors 13 and pinch roller 12 into operative position, the pinch roller holding ribbon 4 against the driving inker wheel 2 and the sensors 13 each straddling the ribbon 4. When this position is reached the driving inker wheel 2 and the friction drive 27 are simultaneously energized along with the stepper motor 18 which operates the cartridge, extruder mechanism. When the optical ink sensors 13 have indicated that sufficient ink has been applied according to the selector on panel 30 the ink supply system and inker wheel drive are now deenergized. The ink sensor and pinch roller assembly are now pivoted to their inoperative position and the friction drive now returns the puller arms and ribbon to their start position at which point the apparatus either stops or ejects the cartridge depending on the type of cartridge feed. The on-off switch will now be positioned to "off" to deenergize the main drive.

In an alternative arrangement (not shown) the use of ink cartridges of a type indicated at cartridge 15 can be omitted and replaced by an ink supply system for injecting ink along the tube 14. One arrangement can include a cylinder and piston drive arrangement in which the cylinder is filled from a supply after retraction of the piston to a filling position. These have a double acting piston arrangement enables one side of the cylinder to be filled while ink is expelled from the other side at the controlled rate which is obtainable by use of the step motor and piston system. In an alternative arrangement a pump can be used to extract the ink from a reservoir supply and injected into the tube 14 at the controlled rate.

The device of the present invention therefore provides an effective and automatic inking system in which the operator can simply place the cartridge into the device and then the inking is effected and controlled automatically by the sensors and by the mechanical movement of the ribbon without the necessity for the operator to manually engage or move the ribbon or observe the inking process.

Figure 5:
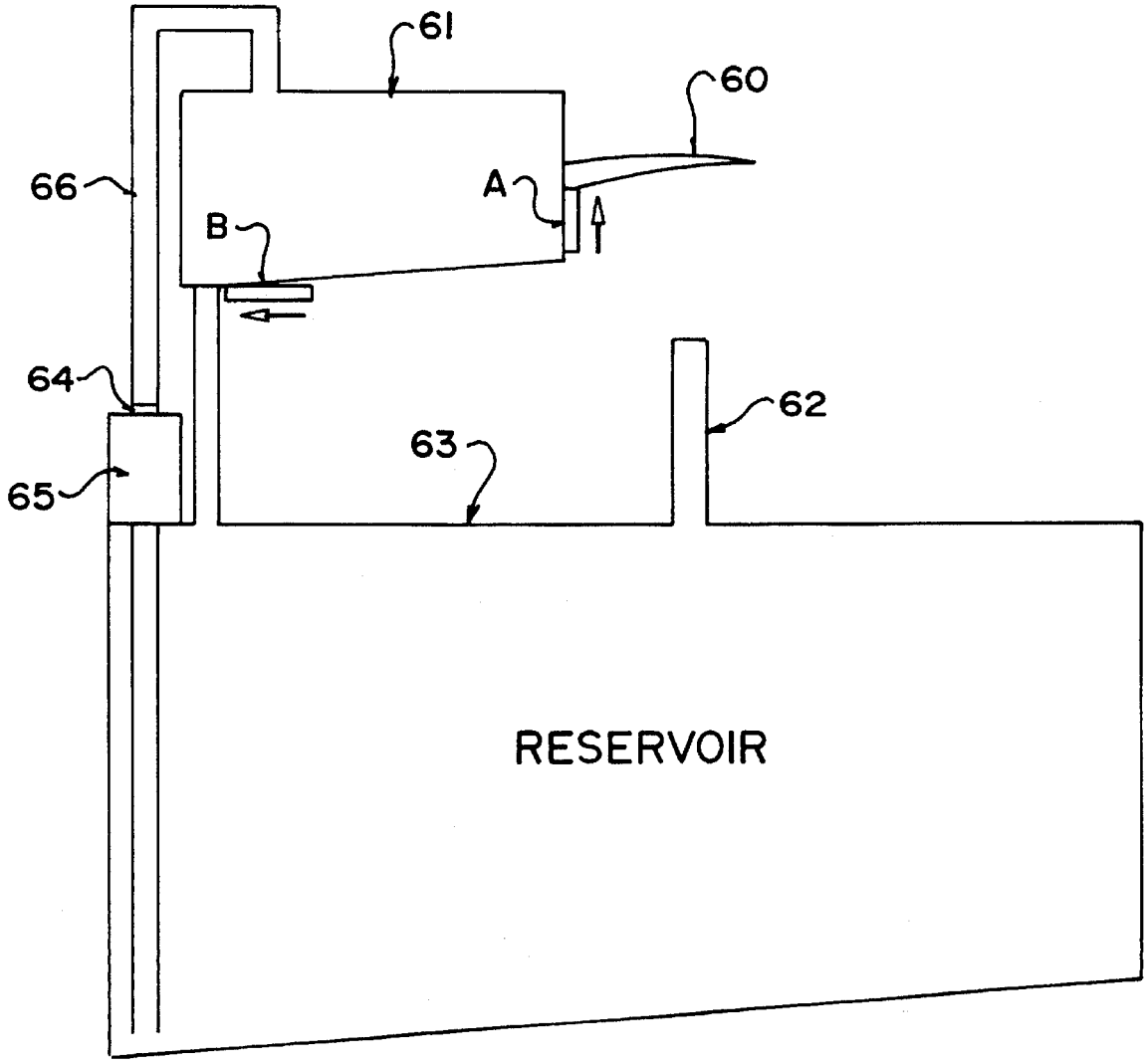
FIG. 5 is a schematic side elevational view of a modified pumping system for the inker of FIGS. 1 through 4.

This pumping system as shown in FIG. 5 replaces the stepper motor system previously described. The start switch on the machine allows the microprocessor to activate the pressure switch 64 on the pump 65 and the solenoid controlling valve B and valve A. The microprocessor ensures both valves A & B are in the closed position. The pump 65 pumps the ink from the reservoir through a filler line 66 into the charge cylinder 61. Following the determination and placement process of drive location and drive direction the microprocessor opens valve A allowing ink to flow through the applicator nozzle 60 for application of ink to the ribbon. At the completion of the inking process the microprocessor signals the solenoid to close valve A. The pressure switch 64 on the pump 65 retains constant pressure in the charge cylinder 61. When the machine switch is turned OFF the microprocessor shuts off the pump 65 and operates the solenoid to open valve "B" to allow back drain of ink back into the reservoir 63. The charge cylinder 61 is tapered to assist back flow to the reservoir 63 via gravity.

The application nozzle 60 is slightly inclined to allow ink to back flow into the charge cylinder 61, preventing nozzle clogging and dripping of ink onto the deck or working parts. A fill spout 62 is attached to the top of the reservoir 63 either in a vertical position or to the exterior of the housing, where the ink can be inserted with a tab type of door closure to prevent air from entering and ink from spilling out of the reservoir. The reservoir is designed with solenoids encapsulated in plastic with electrical connections exposed such that the whole charge tank can be replaced for maintenance. The application nozzle is designed to screw in location to allow for easy replacement for that part, in instances where inactivity of the machine may induce nozzle clogging.

Figure 6:
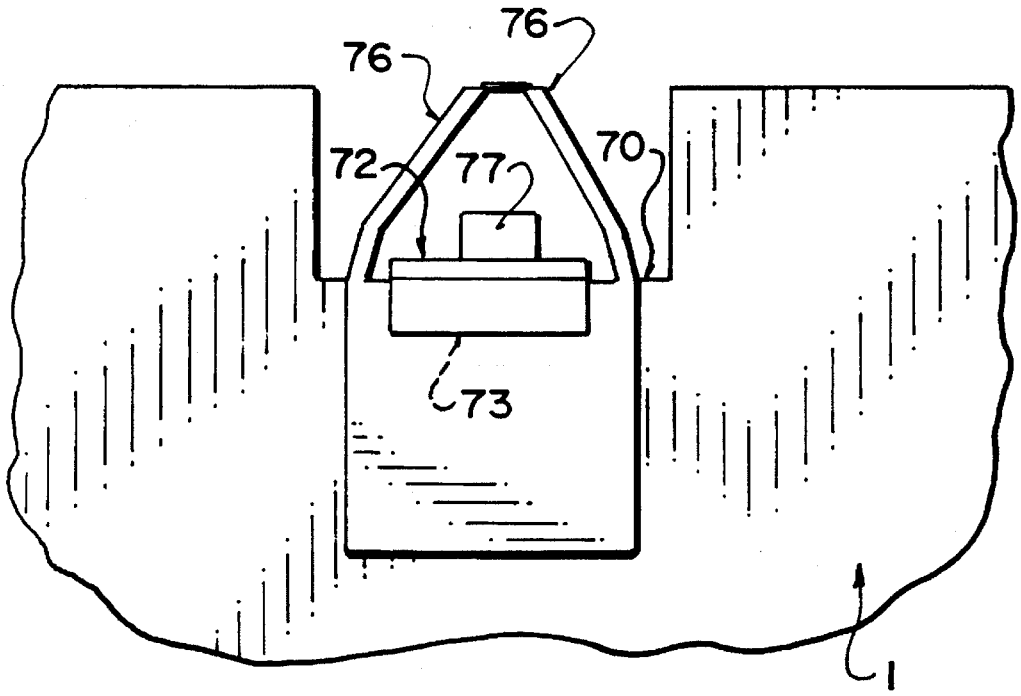
FIG. 6 is a top plan view of a tab support for securing the ribbon cartridge to the deck for use with the arrangements of FIGS. 1 through 4.
Figure 7:
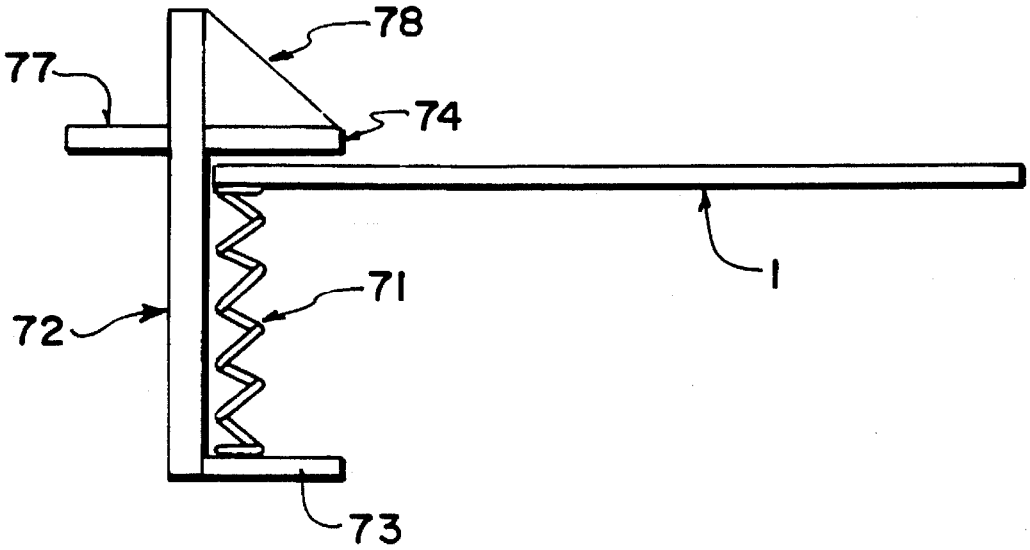
FIG. 7 is a side elevational view of the tab support arrangement of FIG. 6.

A securing mechanism (clamp) is shown in FIGS. 6 and 7 which is necessary to prevent the ribbon cartridge from being "pulled" towards the re-inking wheel and to avoid a "rolling" action in the direction of the ribbon movement during the re-inking process. This mechanism called the tab 72 is mounted in a front deck front cut away 70 of the deck. The tab has a tension spring 71 attached between the bottom of the deck 1 and the tab base 73. The tab 72 is manually lifted by the operator, using a tab lift assist lever 77, then the cartridge is placed so the front opening of the cartridge case fits up securely against the lifted tab. The tab securing lip 74 and its support 78 fits over the front portion of the cartridge case and particularly the cartridge arms 76 securing the cartridge in place for the inking process. It is expected that a 1½" tab securing lip is necessary for static positioning of the cartridge case.

I claim:

1. A ribbon inking device for inking an endless ribbon movably mounted in a ribbon cartridge with a loop of the ribbon exposed from the cartridge and a drive member on the cartridge for feeding the ribbon from the loop back into the cartridge, the device comprising a base, main drive means mounted on the base, ink applying means mounted on the base and including an ink supply, ribbon driving means for driving said ribbon from said loop over said inking means, said ribbon driving means being driven from said main drive means, ribbon positioning means for grasping said ribbon at said loop and for moving the ribbon into position for driving by said ribbon driving means, cartridge drive means for driving said drive member on the cartridge, cartridge support means including a support table mounted on said base and means for moving the cartridge drive means to a required location for engagement with said drive member of said cartridge on said cartridge support means.

2. The device according to claim 1 wherein the ribbon positioning means comprises grasping finger means for grasping the ribbon in the loop and means for moving the grasping finger means from a first position retracted from the loop, to a second position inserted into the loop and to a third position retracted away from the cartridge to pull the loop out of the cartridge.

3. The device according to; claim 1 wherein the ink applying comprises a cylindrical wheel having a peripheral surface around which the ribbon engages, the wheel being formed with a surface thereof of a porous material, and ink extrusion means for extruding ink onto the peripheral surface of the wheel at a position spaced from the engagement thereof with the ribbon such that the wheel carries the ink on the porous surface thereof into engagement with the ribbon.

4. The device according to claim 3 wherein the extrusion means comprises a cylinder containing ink and a piston movable longitudinally of the cylinder for expelling the ink at a controlled rate from the cylinder for passage through a tube onto the wheel.

5. The device according to claim 1 including first ribbon monitoring means positioned upstream of the ink applying means and second monitoring means mounted downstream of the ink applying means, each of said first and second monitoring means being arranged to detect changes in optical characteristics of the ribbon for detecting the proper application of ink, the completion of a full circuit of the ribbon through the ink applying means and for detecting the absence of a ribbon.

6. The device according to claim 5 including timing means for detecting a period of time necessary for completion of the full circuit of the ribbon and control means for controlling driving said ribbon through a second circuit to make a second application of link thereto for a time period equal to the time period for the first circuit.

7. The device according to claim 5 including means for detecting a height on the ribbon of a band from which the ink has been primarily used and means for adjusting the position of the ink applying means for application of the ink preferentially to the band.

8. The device according to claim 1 wherein the ink applying means comprises a cylindrical inker wheel against a peripheral surface of which the ribbon is engaged, said ribbon drive means comprising a pinch roller for pressing the ribbon against the inker wheel for pinching the ribbon therebetween for driving of the ribbon and for proper ink dispersion, there being provided monitoring means for monitoring the ribbon adjacent the inker wheel, the pinch roller and the monitoring means being mounted on a support member, said support member including said pinch roller and said monitoring means being pivotal from a first position above the inker wheel downwardly to bring the pinch roller into contact with the inker wheel and the monitoring means into position adjacent the ribbon.

9. The device according to claim 1 wherein the cartridge support means includes an adapter plate associated with a particular type of cartridge, the adapter plate including means locating the cartridge drive means such that the cartridge drive means is moved to a position on the base for cooperation with the particular type of cartridge.

10. The device according to claim 9 wherein the locating means comprises means for scanning the support table to detect the location the drive member on the cartridge and control means for moving said cartridge drive means in response to the detected location.

* * * * *